US010961073B2

(12) United States Patent
Rasmussen et al.

(10) Patent No.: US 10,961,073 B2
(45) Date of Patent: Mar. 30, 2021

(54) MEDIA GUIDES

(71) Applicant: Hewlett-Packard Development Company, L.P., Spring, TX (US)

(72) Inventors: Steve O Rasmussen, Vancouver, WA (US); Bruce G Johnson, Vancouver, WA (US); Elliott Downing, Vancouver, WA (US); Tom McCue, Vancouver, WA (US); Gene Jones, Puyallup, WA (US); Todd M Gaasch, Vancouver, WA (US); Jonathan C Spafford, Vancouver, WA (US); Anthony W Ebersole, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 51 days.

(21) Appl. No.: 16/332,064

(22) PCT Filed: Sep. 12, 2016

(86) PCT No.: PCT/US2016/051373
§ 371 (c)(1),
(2) Date: Mar. 11, 2019

(87) PCT Pub. No.: WO2018/048453
PCT Pub. Date: Mar. 15, 2018

(65) Prior Publication Data

US 2019/0225446 A1 Jul. 25, 2019

(51) Int. Cl.
*B65H 29/26* (2006.01)
*B65H 29/50* (2006.01)
(Continued)

(52) U.S. Cl.
CPC ..... *B65H 29/50* (2013.01); *B65H 29/10* (2013.01); *B65H 29/26* (2013.01); *B65H 29/34* (2013.01);
(Continued)

(58) Field of Classification Search
CPC ..... B65H 29/26; B65H 29/34; B65H 29/52; B65H 2301/4212; B65H 2301/42125;
(Continued)

(56) References Cited

U.S. PATENT DOCUMENTS 3,420,386 A 1/1969 Morrow et al.
3,532,230 A 10/1970 Gutberiet et al.
(Continued)

FOREIGN PATENT DOCUMENTS

CN 1311101 A 9/2001
CN 101269762 A 9/2008
(Continued)

OTHER PUBLICATIONS

Xerox Nuvera, Manage Paper Curl—http://ww.support.xerox.com/—2007—2 pages.

*Primary Examiner* — Jeremy R Severson
(74) *Attorney, Agent, or Firm* — HP Inc. Patent Department

(57) ABSTRACT

An example system includes an advancement mechanism to drive print media into a stacking region, a movable media guide arrangement and a controller. The movable media guide arrangement includes a pair of opposing media guides to receive opposing edges of a print medium therein and a translation mechanism to move the opposing media guides between at least two positions, the at least two positions including a deployed position and a retracted position. The controller is to actuate the translation mechanism to move the opposing media guides into the deployed position when
(Continued)

the advancement mechanism transports a print medium into the stacking region and to actuate the translation mechanism to move the opposing media guides to the retracted position to release the print medium.

20 Claims, 6 Drawing Sheets

(51) Int. Cl.

| | |
|---|---|
| ***B65H 29/10*** | (2006.01) |
| ***B65H 29/52*** | (2006.01) |
| ***B65H 43/00*** | (2006.01) |
| ***B65H 31/20*** | (2006.01) |
| ***B65H 29/34*** | (2006.01) |

(52) U.S. Cl.
CPC ..... *B65H 29/52* (2013.01); *B65H 31/20* (2013.01); *B65H 43/00* (2013.01); *B65H 2301/4212* (2013.01); *B65H 2301/4431* (2013.01); *B65H 2403/41* (2013.01); *B65H 2404/611* (2013.01); *B65H 2404/693* (2013.01); *B65H 2801/06* (2013.01)

(58) Field of Classification Search
CPC ..... B65H 2301/443; B65H 2301/4431; B65H 2301/44331; B65H 2301/44351; B65H 2403/41; B65H 2404/611; B65H 2404/691; B65H 2404/693
See application file for complete search history.

(56) References Cited

U.S. PATENT DOCUMENTS

| | | | | |
|---|---|---|---|---|
| 3,951,264 | A * | 4/1976 | Heidecker ..... | G11B 17/049 206/308.3 |
| 4,526,358 | A | 7/1985 | Ura et al. | |
| 6,042,106 | A | 3/2000 | Kelly et al. | |
| 7,532,845 | B2 | 5/2009 | Gross et al. | |
| 7,653,340 | B2 | 1/2010 | Shida et al. | |
| 8,086,158 | B2 | 12/2011 | Domoto et al. | |
| 8,123,209 | B2 | 2/2012 | Kubota et al. | |
| 8,292,421 | B2 | 10/2012 | Mandel et al. | |
| 2008/0303200 | A1 | 12/2008 | Ogushi | |

FOREIGN PATENT DOCUMENTS

| | | | |
|---|---|---|---|
| CN | 103569726 | | 2/2014 |
| CN | 205204428 | | 5/2016 |
| JP | H08337026 | A | 12/1996 |
| JP | H09136757 | A | 5/1997 |
| JP | 5125064 | B2 | 1/2013 |
| JP | 2014019569 | | 2/2014 |

* cited by examiner

MEDIA GUIDES

BACKGROUND

Imaging systems, such as printers, generally include a stacking region for the collection of print media. The stacking region may be an output region where a user may receive the print media. In some examples, imaging systems may be provided with a finishing mechanism where the print media may be collected for post processing, such as stapling, three-hole punching, etc. In this regard, the stacking region may be within the imaging system where the print media are collected for post processing.

BRIEF DESCRIPTION OF THE DRAWINGS

For a more complete understanding of various examples, reference is now made to the following description taken in connection with the accompanying drawings in which.

DETAILED DESCRIPTION

Various examples provide for stacking of print media, such as a sheet, as it is delivered onto a stacking region which may collect a stack of sheets. The example system reduces or eliminates offset between the various sheets in the output stack to facilitate various post-processing functions, such as stapling. The system further reduces or eliminates curling of the edges of the sheets in the stack. In various examples, a system may be provided with movable media guides which may receive edges of a print medium. In this regard, the media guides may isolate the incoming sheet from sheets that may already be in the stack. At a predetermined position, the incoming print medium may be released from the media guides by moving the media guides outward and away from the print medium. The print medium is also released from the advancement mechanism transporting the print medium into the stacking region. In various examples, the release of the print medium from the advancement mechanism may occur before, after or simultaneously with the release of the print medium from the movable media guides.

As described above, in some examples, print media may be collected for post processing, such as stapling, three-hole punching. In some cases, such as in inkjet printers where the ink may not be fully dried during stacking, alignment of sheets in a stack may become difficult. For example, the inkjet output sheets may be distorted from curl forming on the edges. Further, due to the moisture content, the sheets may have reduced stiffness which adds to the curl, and high ink density regions may result in increased friction with adjacent sheets. The friction can result in misalignment with other sheets in the stack. Additionally, curling of reduced stiffness in the sheets can result in trapped air between the sheets. The trapped air can result in a variety of issues, such as an artificial increase in stack height.

Accordingly, the present disclosure describes example systems and methods to facilitate alignment of sheets in a stack and reducing curling. Various examples described herein provide using movable media guides which receive the edges of the incoming sheet. The movable media guides isolate the incoming print medium from other sheets that may already be in the stack. While isolated, the media guides may reduce or eliminate curling in the edges of the incoming print medium by retaining then in the rigid media guides.

Figure 1:
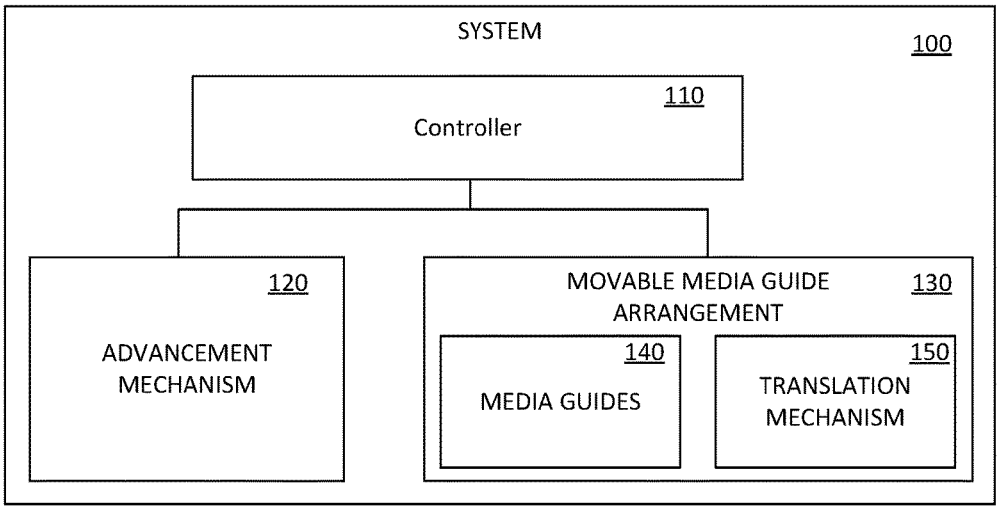
FIG. 1 is a schematic illustration of an example system with movable media guides.

Referring now to the figures, FIG. 1 illustrates an example system with movable media guides is schematically illustrated. The example system 100 may be implemented in a variety of imaging devices, such as printers or copiers, for example. In some examples, the example system 100 of FIG. 1 is implemented in a finishing portion of an imaging device. The example system 100 includes a controller 110 to control operation various aspects of the example system 100. In some examples, the controller 110 may be a part of a processor of a larger system, such as an imaging system which contains the example system 100 as a finishing portion. The controller 110 of the example system 100 may be implemented as hardware, software, or firmware, for example.

The example system 100 further includes an advancement mechanism 120 to transport print media into a stacking region. In various examples, the advancement mechanism 120 may include rollers and/or puller clamps which translate to move the print media from an output of an imaging portion, for example, into the stacking region. The controller 110 may be provided with an indication of an incoming print medium and may, in response, position the advancement mechanism 120 to transport the incoming print medium into the stacking region.

The example system 100 of FIG. 1 further includes a movable media guide arrangement 130. The movable media guide arrangement 130 of the example system 100 is provided to reduce or eliminate curling, particularly on the edges of the incoming print media, and to facilitate alignment of the incoming print medium with other media that may be in the stacking region.

The movable media guide arrangement 130 of the example system 100 is provided with a pair of opposing media guides 140 positioned on sides of incoming print media above the stacking region. In this regard, as described in various examples below, the media guides 140 may include channels which may receive opposing side edges of an incoming print medium. Further, the media guides 140 serve to isolate the incoming print medium from sheets that may already be in a stack in the stacking portion.

The movable media guide arrangement 130 of the example system 100 is further provided with a translation mechanism 150. In various examples, the translation mechanism 150 may move the opposing media guides between at least two positions. For example, the translation mechanism 150 may selectively move the opposing media guides to a deployed position or to a retracted position.

The controller 110 may selectively actuate the translation mechanism 150 to move the opposing media guides 140. In particular, the controller 110 may actuate the translation mechanism 150 to move the opposing media guides 140 into the deployed position when the advancement mechanism 120 transports a print medium into the stacking region.

Similarly, the controller 110 may actuate the translation mechanism 150 to move the opposing media guides 140 to the retracted position to release the print medium from the opposing media guides 140.

Figure 2:
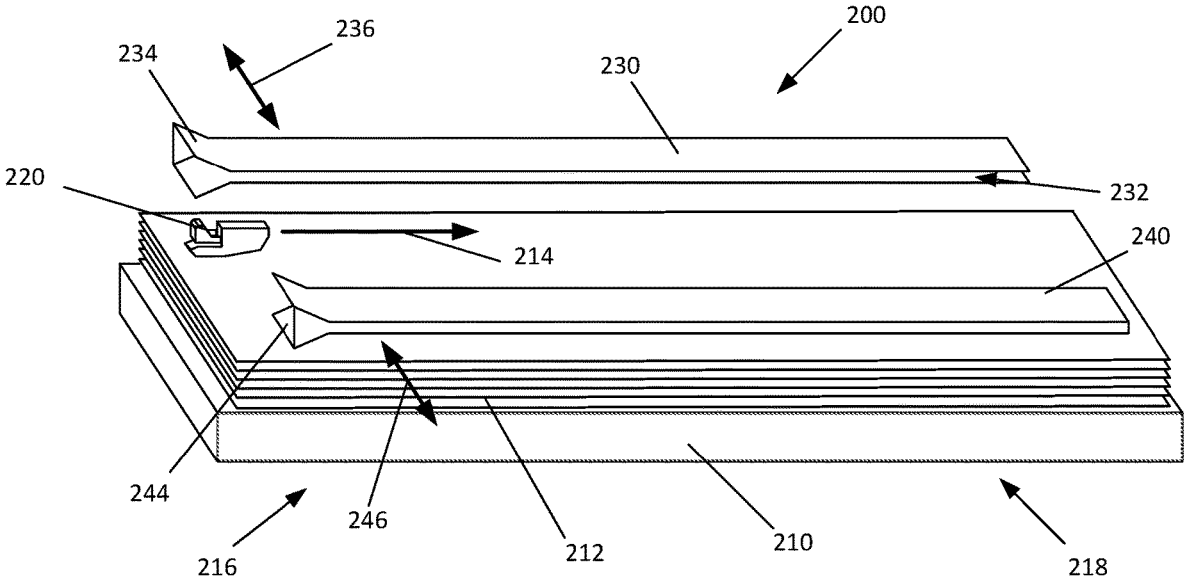
FIG. 2 is a perspective illustration of another example system with movable media guides.

Referring now to FIG. 2, an example system 200 is illustrated in a perspective view. The example system 200 of FIG. 2 includes a platform 210 for accommodating a stack 212 of print media, such as sheets of paper. In this regard, the platform 210 forms a stacking region for the print media. In the example of FIG. 2, the print media are transported onto the platform 210 in the direction indicated by the arrow 214. Accordingly, the stacking region formed by the platform 210 includes a trailing edge portion 216 on which the trailing edge of the transported media rests when stacked. Similarly, the platform 210 includes a downstream, or leading edge, portion 218 which is downstream of the trailing edge portion 216.

The example system 200 of FIG. 2 includes an advancement mechanism 220. The advancement mechanism 220 of the example system 200 may be a puller clamp which may engage a leading edge of a print medium (not shown) as the print medium is delivered into the stacking region of the platform 210 from, for example, an image forming portion (not shown). The puller clamp may then translate in the direction of the arrow 214, thus transporting the print medium onto the platform 210 or the stack 212. Of course, various examples of the advancement mechanism 220 (e.g., the puller clamp) may include various components not shown, such as gearing mechanism, to facilitate operation of the advancement mechanism 220. Further, as described above with reference to FIG. 1, operation of the advancement mechanism 220 may be controlled by a controller (not shown in FIG. 2).

The example system 200 of FIG. 2 includes opposing media guides 230, 240 which extend longitudinally in the direction of transport 214 of the incoming print medium. In the example illustrated in FIG. 2, the opposing media guides 230, 240 extend substantially the length of the stacking region formed by the platform 210. In other examples, the opposing media guides 230, 240 may be sized for any desired length, such as extending only the trailing half or trailing quarter of the stacking region, for example. In some examples, the size of the opposing media guides 230, 240 may be selected to provide clearance for other components of the example system not shown in FIG. 2.

Each of the opposing media guides 230, 240 is provided with a channel, such as channel 232 of the opposing media guide 230, on the inside (side facing the other opposing media guide) of the opposing media guide 230, 240. The channel 232 is to receive a side edge of the print media therein. In one example, the channel 232 has a height sufficient to accommodate a single sheet of print media. In one example, the channel 232 has a height selected to hold the edge of the print media substantially flat to prevent curling of the print media. For example, the height of the channel 232 may be about 5 mm or less.

In the example illustrated in FIG. 2, each of the opposing media guides 230, 240 is provided with a lead-in portion 234, 244. The lead-in portion 234, 244 is provide at the trailing edge portion 216 where print media enters the stacking region. The lead-in portion 234, 244 of the example system of FIG. 2 is provided with a funnel shape to facilitate entry of the print media into the channel 232 of the opposing media guides 230, 240.

The opposing media guides 230, 240 are movable to facilitate receiving and releasing of print media. In the example of FIG. 2, the opposing media guides 230, 240 can selectively move toward each other or away from each other, as indicated by the arrows 236, 246. In other examples, the opposing media guides 230, 240 can also selectively move up or down to vary distance between the opposing media guides 230, 240 and the stack 212 or the platform 210. The movement of the media guides may be facilitated by a translation mechanism (not shown in FIG. 2), examples of which are described below with reference to FIGS. 8 and 9.

Figure 3:
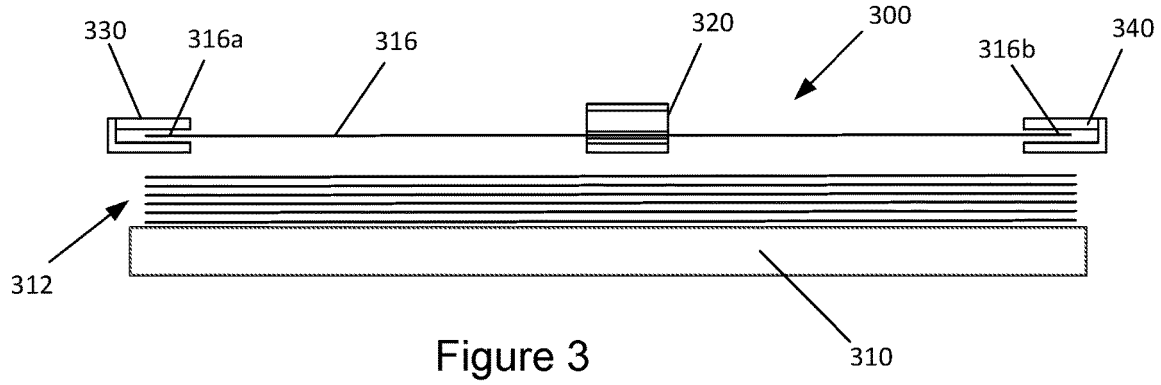
FIGS. 3-7 are front views of an example system illustrating an example process using movable media guides.

Referring now to FIGS. 3-7, front views of an example system illustrating an example process using movable media guides are illustrated. Referring first to FIG. 3, the example system 300 is illustrated with a stack 312 of sheets of print media on a platform 310. The stack 312 is positioned on the platform 310 with an incoming sheet 316 entering the stacking region. As the incoming sheet 316 is delivered to the stacking region from, for example, an image forming portion, it may be engaged by the puller clamp 320. As described above, operation of the puller clamp 320 may be controlled by a controller (e.g., the controller 110 of FIG. 1). Further, sensors may be provided to indicate to the controller that the incoming sheet 312 is in a position to be engaged by the puller clamp 320. Once engaged by the puller clamp 320, the sheet is transported toward the stacking region formed by the platform 310 (into the page in FIG. 3).

As illustrated in FIG. 3, during transportation of the print medium 316 into the stacking region, the side edges 316*a*, 316*b* of the print medium 316 are directed into corresponding movable media guides 330, 340. In this regard, prior to delivery of the print medium 316 into the stacking region, the movable media guides 330, 340 are moved into the appropriate position to receive the print medium 316.

Figure 4:
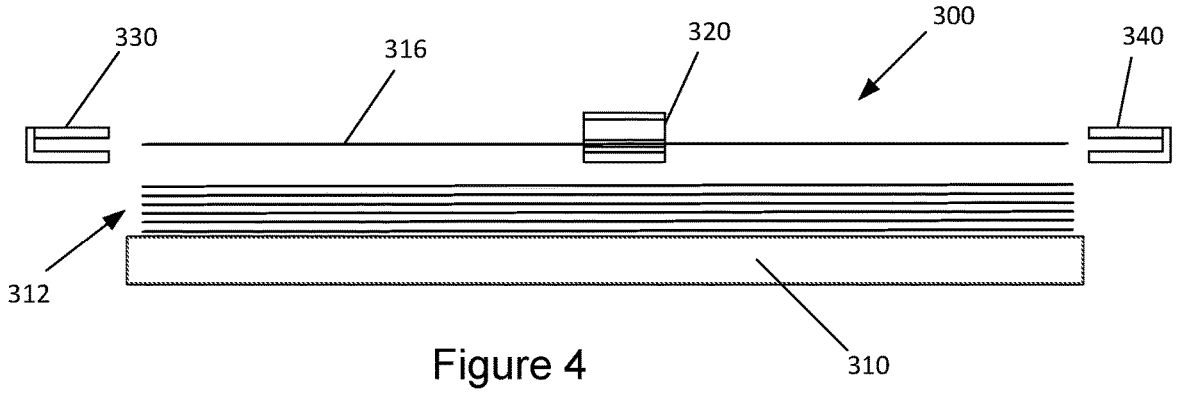

Once the print medium 316 has reached a predetermined position in the stacking region, the movable media guides 330, 340 may be retracted, as illustrated in FIG. 4. In this regard, the movable media guides 330, 340 may be moved outward away from the print medium, thus releasing the print medium from the movable media guides. For example, as illustrated in FIG. 4, the left media guide 330 is moved leftward away from the right media guide 340, and the right media guide 340 is moved rightward away from the left media guide 330. As noted above, movement of the movable media guides 330, 340 may be effected by a translation mechanism not shown in FIGS. 3-7. Example translation mechanisms are described below with reference to FIGS. 8 and 9. In the example illustrated in FIG. 4, while the print medium 316 is released from the movable media guides 330, 340, it remains engaged by the puller clamp 320.

In various examples, the print medium 316 may be released from the movable media guides 330, 340 after registration of the print medium 316 in the direction of transport, or into the paper (e.g., X-registration). In other examples, X-registration may occur immediately after release of the print medium 316 from the movable media guides 330, 340.

Figure 5:
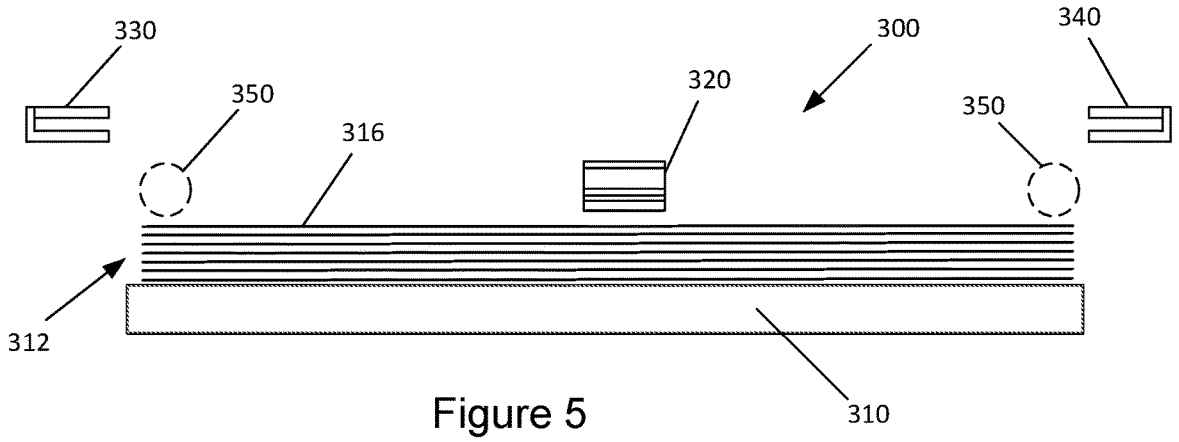

Referring now to FIG. 5, the print medium 316 is released from the puller clamp 320 and falls onto the stack 312. Registration of the print medium 316 in the direction perpendicular to the direction of transport (e.g., left or right in FIG. 5) may occur as the print medium is released from the puller clamp 320.

As further illustrated in FIG. 5, the movable media guides 330, 340 are raised to a predetermined height. The predetermined height may be selected based on several factors, including but not limited to the desired capacity of the stack in the stacking region. Further, the predetermined height may be selected to provide clearance above any potential curling of media on the stack 312. The region of potential curling is indicated in FIG. 5 with dashed circles 350 Vertical translation of the movable media guides 330, 340 may be achieved by a translation mechanism, such as the example translation mechanism described below with reference to FIG. 9.

Figure 6:
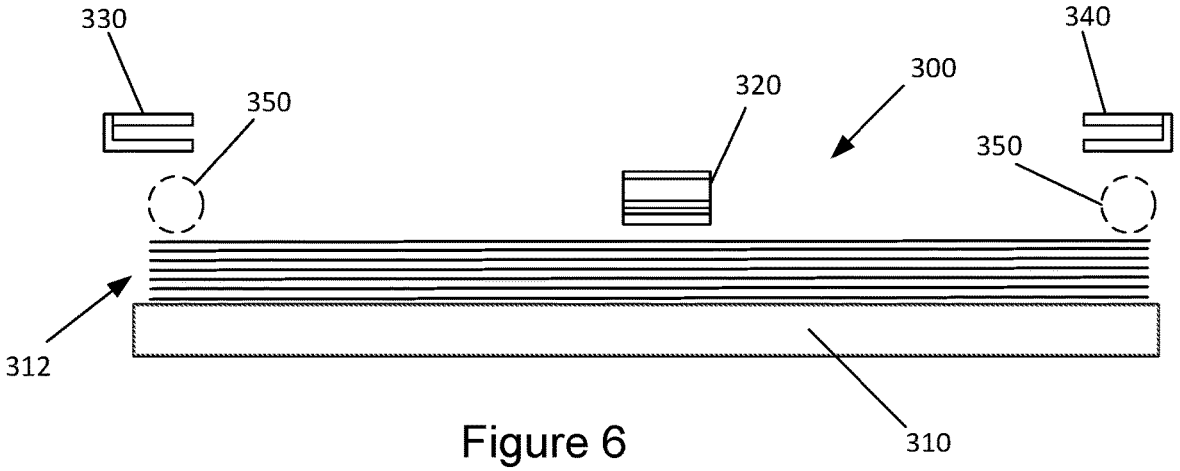

Referring now to FIG. 6, the movable media guides 330, 340 are deployed by moving the movable media guides 330, 340 inward. In this regard, the positioning of the movable media guides 330, 340 may correspond to the width of an incoming print medium. For example, the distance between the movable media guides 330, 340 may correspond to the width of the next sheet expected into the stacking region. Since the movable media guides 330, 340 are in a raised position, they can avoid any curling or other deformities that may exist in the stack 312. As indicated in FIG. 6, the movable media guides 330, 340 are clear of the potential curling zones 350.

Figure 7:
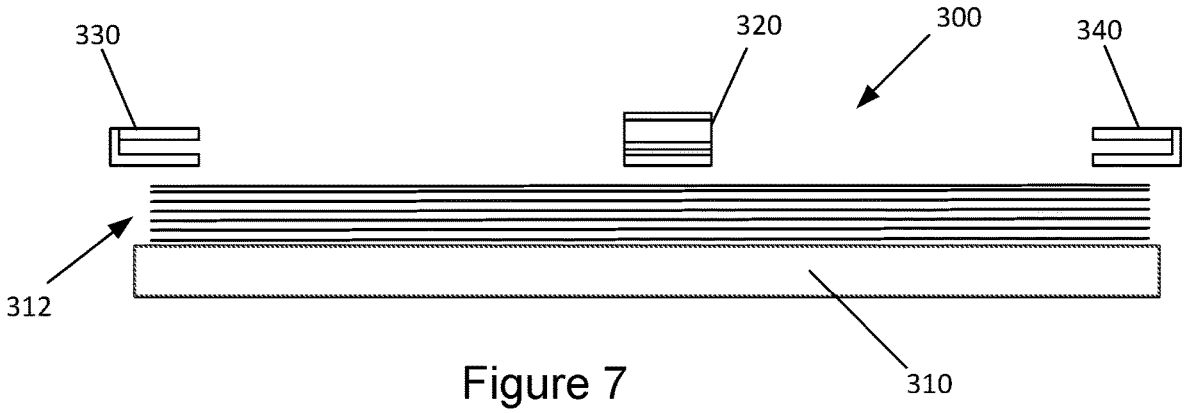

Finally, the movable media guides 330, 340 may be lowered, as illustrated in FIG. 7. In this regard, the movable media guides 330, 340 are lowered to substantially match the height of the incoming print medium. Further, the positioning of the movable media guides 330, 340 isolates the incoming print medium from any curling that may exist on the edges of the print media on the stack 312. For example, the movable media guides 33, 340 may be lowered to match the height of the puller clamp 320. Thus, the system 300 is now in position to receive an incoming print media into the movable media guides 330, 340.

Figure 8:
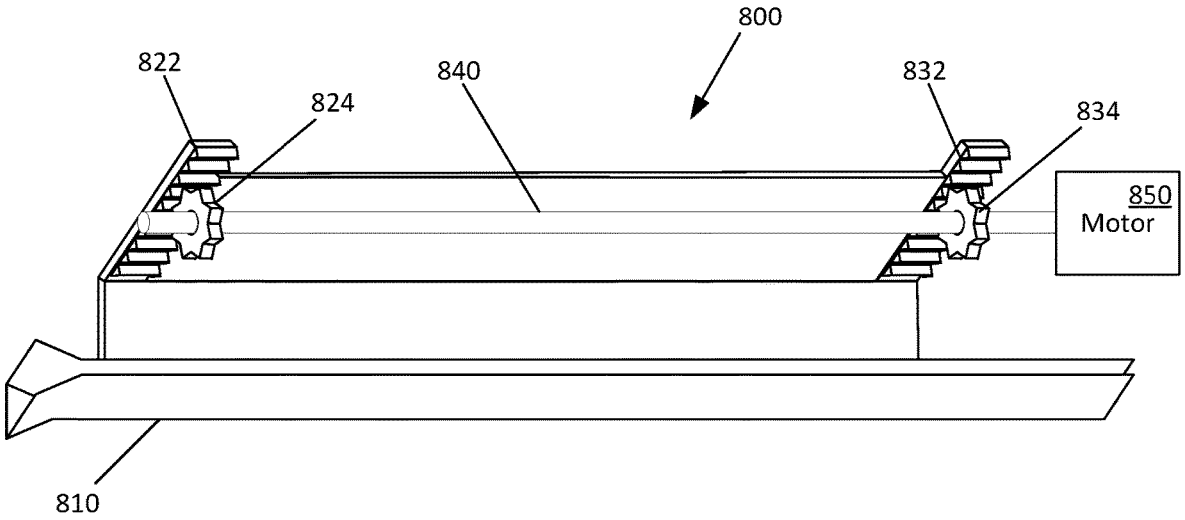
FIG. 8 is a perspective view of an example translation mechanism.

Referring now to FIG. 8, a perspective view of an example translation mechanism is illustrated. The example translation mechanism 800 is coupled to a media guide 810, similar to the movable media guides described above. The example translation mechanism 800 of FIG. 8 includes translation racks 822, 832 extending in a direction that is perpendicular to the direction of transport of the incoming print media. In this regard, the translation racks 822, 832 are perpendicular to the longitudinal extension of the media guide 810.

Each translation rack 822, 832 is provided with teeth to engage a corresponding pinion 824, 834. Each pinion 824, 834 rotates with a common shaft 840 that may be driven by a motor (not shown). As the shaft 840 rotates in one direction, the racks 822, 832 are translated outward, thus moving the media guide outward. Similarly, as the shaft 840 rotates in the opposite direction, the racks 822, 832 are translated inward, thus moving the media guide inward.

Each media guide of the pair of opposing media guides may be provided with a separate translator. Thus, each media guide of the pair of opposing media guides can be translated independently. This may allow the media guides to accommodate different sizes of print media.

Figure 9:
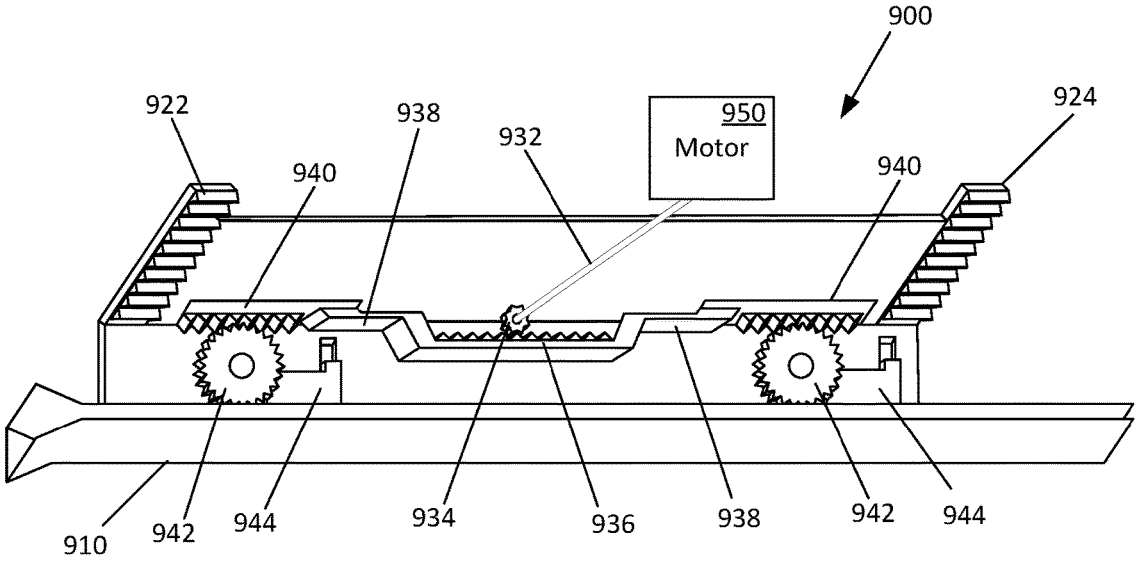
FIG. 9 is a perspective view of another example translation mechanism

Referring now to FIG. 9, a perspective view of another example translation mechanism is illustrated. While the example translation mechanism 800 of FIG. 8 facilitated movement of the media guides inward and outward (e.g., laterally), the example translation mechanism 900 of FIG. 9 facilitates vertical movement of the media guides. As illustrated in FIG. 9, the vertical translation mechanism 900 may be combined with the lateral translation mechanism. Accordingly, the example vertical translation mechanism 900 includes racks 922, 924 similar to the racks 822, 824 of FIG. 8.

The example vertical translation mechanism 900 of FIG. 9 is coupled to a media guide 910, similar to the movable media guides described above. The example vertical translation mechanism 900 includes a shaft 932 which may be driven by a motor (not shown). The shaft 932 is coupled to a pinion 934 at one end, the rotation of which engages teeth on an input rack 936. Rotation of the pinion 934 causes translation of the input rack 936. The input rack 936 is coupled to a rack bar 938 which extends longitudinally substantially parallel to the media guide 910. The rack bar 938 translates with the input rack 936. The rack bar 938 is coupled to an output rack 940 which translates with the input rack 936 and the rack bar 938. Translation of the output rack 940 causes rotation of a gear 942 causing vertical movement of a vertical slide 944. The vertical slide is directly coupled to the media guide 910 and causes corresponding vertical movement of the media guide 910. Thus, as the shaft 932 is rotated in one direction, the media guide 910 is raised, and as the shaft 932 is rotated in the opposite direction, the media guide 910 is lowered. In various examples, the shaft 932 and the motor driving the shaft may be common to each media guide of the pair of opposing media guides. Thus, the vertical positioning of the two media guides may be synchronized.

Figure 10:
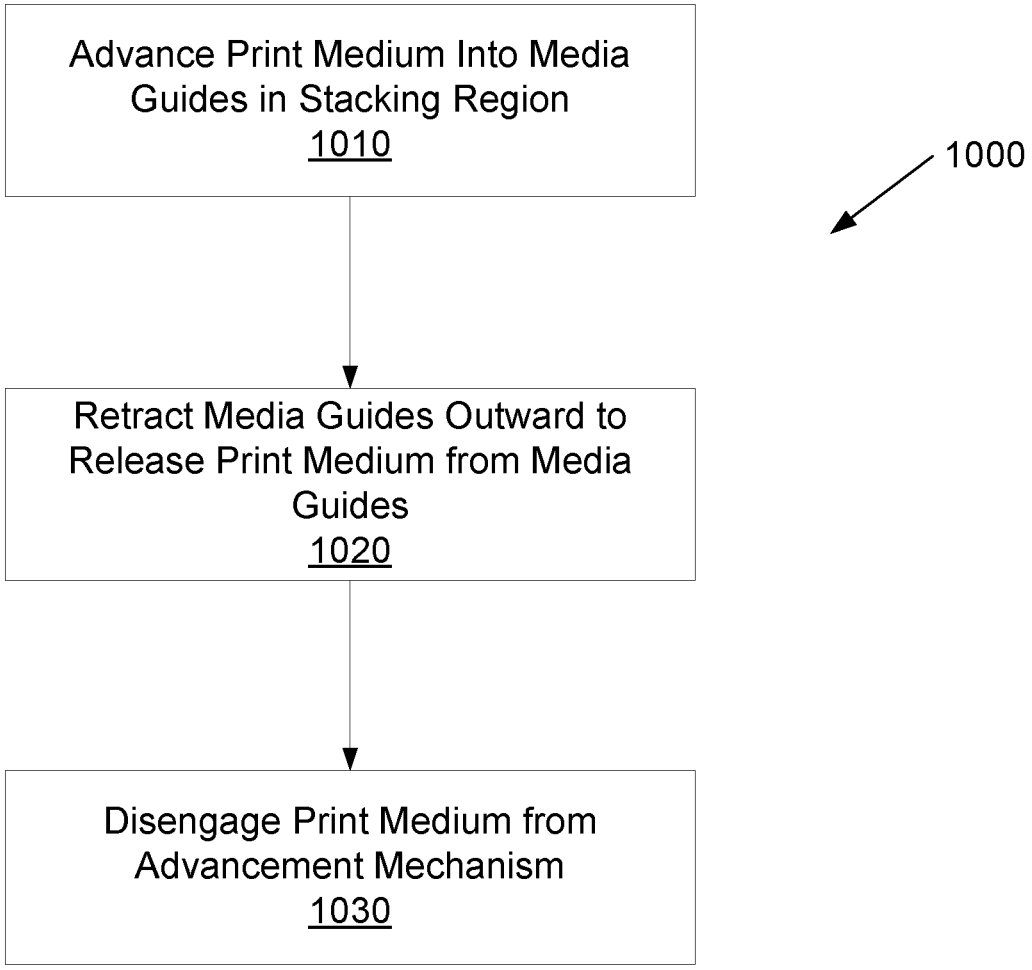
FIG. 10 is a flow chart illustrating an example process using movable media guides.

Referring now to FIG. 10, a flow chart illustrates an example method using movable media guides. The example method 1000 of FIG. 10 may be implemented in a variety of manners, such as in the controller 110 of the example system 100 of FIG. 1.

The example method 1000 includes advancing of a print medium into a stacking region (block 1010). In this regard, edges of the print medium are directed into corresponding movable media guides. For example, as illustrated above with reference to FIGS. 3-7, during transportation of the print medium 316 into the stacking region by the puller clamp 320, the side edges 316*a*, 316*b* of the print medium 316 are directed into corresponding movable media guides 330, 340.

When the print medium reaches a predetermined position, the media guides are retracted outward away from the print medium to release the print medium from the movable media guides (block 1020). For example, as described above with reference to FIG. 4, the left media guide 330 is moved leftward away from the right media guide 340, and the right media guide 340 is moved rightward away from the left media guide 330.

The example method 1000 further includes disengaging the print medium from the advancement mechanism (block 1030). For example, as described above with reference to FIG. 5, the print medium 316 is released from the puller clamp 320 and falls onto the stack 312.

Figure 11:
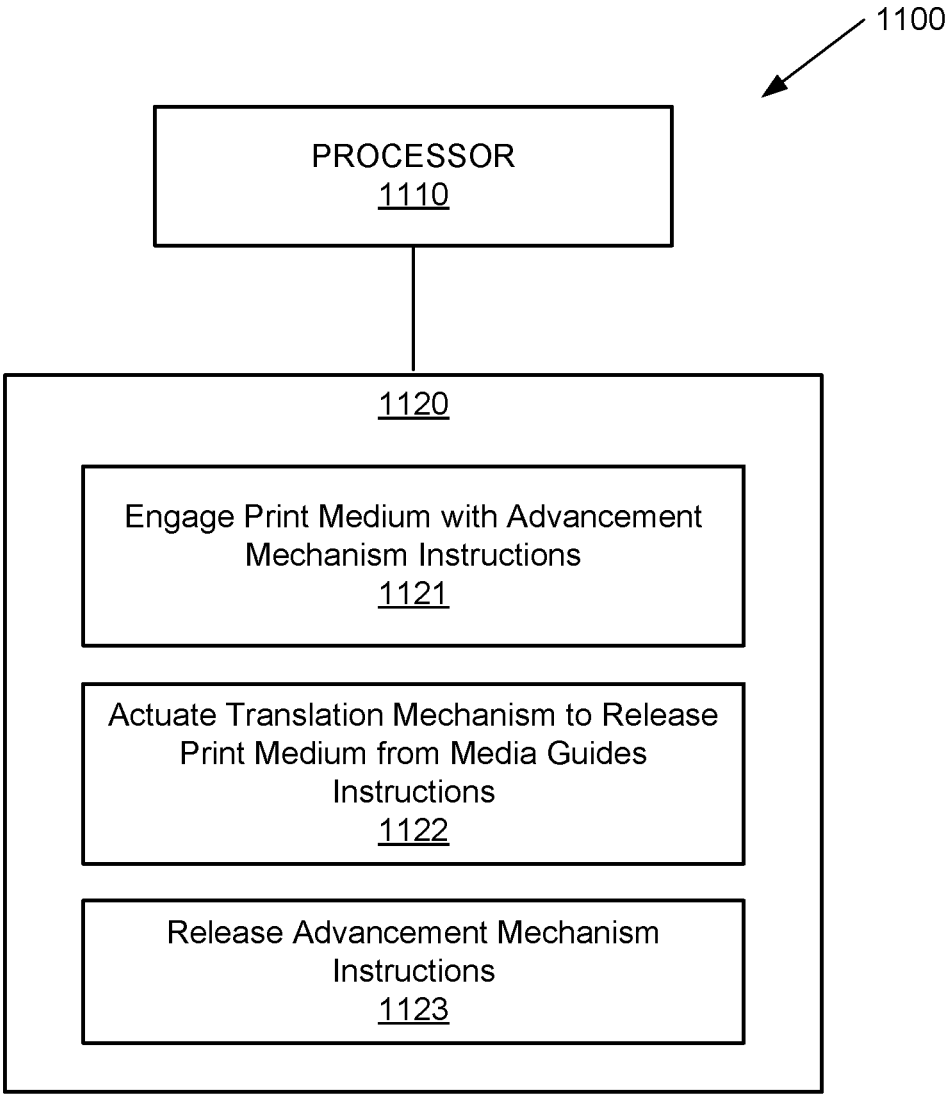
FIG. 11 illustrates a block diagram of an example system with a computer-readable storage medium including instructions executable by a processor for using movable media guides.

Referring now to FIG. 11, a block diagram of an example system is illustrated with a non-transitory computer-readable storage medium including instructions executable by a processor for using movable media guides. The system 1100 includes a processor 1110 and a non-transitory computer-readable storage medium 1120. The computer-readable storage medium 1120 includes example instructions 1121-1123 executable by the processor 1110 to perform various functionalities described herein. In various examples, the non-transitory computer-readable storage medium 1120 may be any of a variety of storage devices including, but not limited to, a random access memory (RAM) a dynamic RAM (DRAM), static RAM (SRAM), flash memory, read-only memory (ROM), programmable ROM (PROM), electrically erasable PROM (EEPROM), or the like. In various examples, the processor 1110 may be a general purpose processor, special purpose logic, or the like.

The example instructions include engaging print medium with advancement mechanism instructions 1121. In this regard, edges of the print medium are directed into corresponding movable media guides. For example, as described above with reference to FIG. 3, during transportation of the print medium 316 into the stacking region by the puller clamp 320, the side edges 316*a*, 316*b* of the print medium 316 are directed into corresponding movable media guides 330, 340.

The example instructions further include actuate translation mechanism to release print medium from media guides instructions 1122. As described above, when the print medium reaches a predetermined position, the media guides may be retracted outward away from the print medium to release the print medium from the movable media guides. For example, the translation mechanism 800 described above with reference to FIG. 8 may be actuated to move the media guides outward away from the print medium.

The example instructions further include release advancement mechanism instructions 1123. For example, as described above with reference to FIG. 5, the print medium 316 is released from the puller clamp 320 and falls onto the stack 312.

Thus, in accordance with various examples described herein, movable media guides may be used to reduce or eliminate curling in a stack of print media.

The foregoing description of various examples has been presented for purposes of illustration and description. The foregoing description is not intended to be exhaustive or limiting to the examples disclosed, and modifications and variations are possible in light of the above teachings or may be acquired from practice of various examples. The examples discussed herein were chosen and described in order to explain the principles and the nature of various examples of the present disclosure and its practical application to enable one skilled in the art to utilize the present disclosure in various examples and with various modifications as are suited to the particular use contemplated. The features of the examples described herein may be combined in all possible combinations of methods, apparatus, modules, systems, and computer program products.

It is also noted herein that while the above describes examples, these descriptions should not be viewed in a limiting sense. Rather, there are several variations and modifications which may be made without departing from the scope as defined in the appended claims.

What is claimed is:

1. A system, comprising:

an advancement mechanism to drive print media into a stacking region;

a movable media guide arrangement, comprising:

a pair of opposing media guides to receive opposing edges of a print medium therein; and a translation mechanism to move the opposing media guides between at least two positions, the at least two positions including a deployed position and a retracted position; and a controller to actuate the translation mechanism to move the opposing media guides into the deployed position when the advancement mechanism transports a print medium into the stacking region and to actuate the translation mechanism to move the opposing media guides to the retracted position to release the print medium from the opposing media guides while the print medium remains engaged by the advancement mechanism.

2. The system of claim 1, wherein the opposing media guides extend longitudinally in a direction of transport of the print medium by the advancement mechanism.

3. The system of claim 1, wherein the opposing media guides extend substantially a length of the stacking region.

4. The system of claim 1, wherein the opposing media guides form channels to receive at least one sheet of print media therein.

5. The system of claim 4, wherein the opposing media guides include a lead-in portion to facilitate entry of print media into the channels.

6. The system of claim 1, wherein the translation mechanism includes a translator coupled to a corresponding media guide of the opposing media guides, each translator including a rack and pinion to facilitate movement of the corresponding media guide.

7. The system of claim 1, wherein the controller is to:

release the print medium from the advancement mechanism after release of the print medium from the opposing media guides.

8. The system of claim 1, wherein the controller is to:

raise the opposing media guides to a predetermined height; and lower the opposing media guides to substantially match a height of the incoming print medium.

9. The system of claim 1, wherein the controller is to:

deploy the opposing guides inward to correspond to a width of an incoming print medium.

10. A method, comprising:

advancing a print medium into a stacking region with an advancement mechanism, the advancing including directing edges of the print medium into corresponding movable media guides;

retracting the movable media guides outward away from the print medium to release the print medium from the movable media guides while the print medium remains engaged by the advancement mechanism; and disengaging the print media from the advancement mechanism.

11. The method of claim 10, further comprising:

raising the movable media guides to a predetermined height;

deploying the movable media guides inward to correspond to a width of an incoming print medium; and lowering the movable media guides to substantially match a height of the incoming print medium.

12. The method of claim 10, wherein the movable media guides extend longitudinally in a direction of the advancing of the print medium into the stacking region.

13. The method of claim 10, wherein the movable media guides extend substantially a length of the stacking region.

14. The method of claim 10, wherein the movable media guides form channels to receive at least one sheet of print media therein.

15. The method of claim 10, wherein disengaging the print media from the advancement mechanism comprises disengaging the print media from the advancement mechanism after retracting the movable media guides.

16. A non-transitory computer-readable storage medium encoded with instructions executable by a processor of a computing system, the computer-readable storage medium comprising instructions to:

engage a print medium with an advancement mechanism to advance the print medium into a stacking region, the advancing including directing edges of the print medium into corresponding movable media guides;

actuate a translation mechanism to release the print medium from the movable media guides while the print medium remains engaged by the advancement mechanism; and release the print medium from the advancement mechanism.

17. The non-transitory computer-readable storage medium of claim 16, wherein instructions to actuate the translation mechanism include instructions to actuate the translation mechanism to move the movable media guide outward and away from the print medium.

18. The non-transitory computer-readable storage medium of claim 17, wherein instructions to actuate the translation mechanism further include instructions to:

raise the movable media guides to a predetermined height;

deploy the media guides inward to correspond to a width of an incoming print medium; and lower the movable media guides to substantially match a height of the incoming print medium.

19. The non-transitory computer-readable storage medium of claim 17, wherein instructions to actuate the translation mechanism include instructions to release the print medium from the advancement mechanism after release of the print medium from the movable media guides.

20. The non-transitory computer-readable storage medium of claim 16, wherein the movable media guides extend substantially a length of the stacking region.

* * * * *